US010152954B2

(12) United States Patent
Klanner

(10) Patent No.: US 10,152,954 B2
(45) Date of Patent: Dec. 11, 2018

(54) MUSICAL STRING

(71) Applicant: Thomastik-Infeld Gesellschaft m.b.H, Vienna (AT)

(72) Inventor: Franz Klanner, Vienna (AT)

(73) Assignee: Thomastik-Infeld Gesellschaft m.b.H, Vienna (AT)

( * ) Notice: Subject to any disclaimer, the term of this patent is extended or adjusted under 35 U.S.C. 154(b) by 4 days.

(21) Appl. No.: 15/468,765

(22) Filed: Mar. 24, 2017

(65) Prior Publication Data

US 2017/0287450 A1 Oct. 5, 2017

(30) Foreign Application Priority Data

Apr. 1, 2016 (AT) ..... A50269/2016

(51) Int. Cl.
*G10D 3/10* (2006.01)

(52) U.S. Cl.
CPC ..... *G10D 3/10* (2013.01)

(58) Field of Classification Search
CPC ..... G10D 3/12; G10D 3/10
See application file for complete search history.

(56) References Cited

U.S. PATENT DOCUMENTS 210,172 A 11/1878 Watson et al.
5,892,166 A 4/1999 Sanderson
2011/0005365 A1* 1/2011 Landtroop ..... G10C 3/06 84/297 S

FOREIGN PATENT DOCUMENTS

DE 3709636 11/1987
JP 53-3021 1/1978

OTHER PUBLICATIONS

Austrian Search Report dated Jan. 23, 2017.
Translation of Austrian Search Report dated Jan. 23, 2017.

* cited by examiner

*Primary Examiner* — Kimberly Lockett
(74) *Attorney, Agent, or Firm* — Henry M. Feiereisen LLC

(57) ABSTRACT

A musical string, in particular a string instrument musical string, has a substantially circularly-cylindrical outer contour and includes an inner part having an inner part cross section delimited by an inner part boundary line. The inner part includes at least one supporting string core. At least in a specifiable length section of the musical string, the inner part boundary line has at least one curved, convex boundary line section. The inner part cross section of the inner part has a width which is greater than a height of the inner part cross section in perpendicular relation to the width.

21 Claims, 4 Drawing Sheets

MUSICAL STRING

CROSS-REFERENCES TO RELATED APPLICATIONS

This application claims the priority of Austrian Patent Application, Serial No. A 50269/2016, filed Apr. 1, 2016, pursuant to 35 U.S.C. 119(a)-(d), the disclosure of which is incorporated herein by reference in its entirety as if fully set forth herein.

BACKGROUND OF THE INVENTION

The present invention relates to a musical string.

The following discussion of related art is provided to assist the reader in understanding the advantages of the invention, and is not to be construed as an admission that this related art is prior art to this invention.

Musical strings generate oscillations, which are generally amplified by the body of a musical instrument, and thus generate the sound of the musical instrument. A musical string is capable of different types of oscillations in this case, which are more or less desired and/or are amplified by the musical instrument or in the musical instrument. In addition to the transverse oscillations which are primarily sought, and which are generally also dominant, furthermore longitudinal oscillations and torsional oscillations can occur in musical strings. Longitudinal oscillations arise, of course, in this case due to the necessary length change of the oscillating musical string when forming a transverse oscillation. The occurrence of torsional oscillations, or the amount of the formation thereof, in contrast, is strongly dependent on the type of the oscillation excitation of the musical string. These occur hardly or not at all, for example, in musical instruments in which controlled impacts are made on the musical string by means of a mechanism, in particular as in a piano, for example, because with this type of excitation, no torque is exerted on the musical string. However, such torsional oscillations occur in the case of oscillation excitation by bowing.

During bowing or during the bowing procedure, a bow treated using rosin is stroked over the musical string. At a certain point of the oscillation cycle, the relative velocity of the musical string drops in relation to the bow such that, as a result of the rosin, adhesion of the musical string on the bow hairs of the bow occurs. The bow thereupon deflects the musical string. However, before a noteworthy deflection occurs in the movement direction of the bow, the musical string is turned by the bow about a certain pivot angle. The actual or intended deflection of the musical string transversely to its longitudinal extension first begins then. This turning is maintained in this case until the musical string is released from the bow. When the musical string springs back, torsional oscillations occur as a result thereof, which are superimposed on the transverse oscillations. Depending on the type and construction of a musical string and of the musical instrument, these torsional oscillations may be perceived more or less clearly, wherein they are subjectively usually perceived or sensed as negative, interfering, or rough, however.

When designing and producing musical strings, their construction should rotationally-symmetrical. Production methods become increasingly more sophisticated, in particular in terms of accuracy of the starting materials and machines used, in an attempt to meet the requirement of a rotationally-symmetrical construction. Still, while manufacturing accuracy increases and tolerances of the materials and semifinished products used decrease, the sound quality of the musical strings has not increased to the same extent. Rather, it could be determined that with increasing manufacturing accuracy, individual effects or sound properties receded or disappeared, but others appeared significantly more clearly than before. In addition to improving several desired properties of the musical strings, it therefore has to be determined that undesired effects now also occur more clearly and above all consistently in all musical strings of a type. It could be recognized in this case that such negatively perceived effects are induced above all by torsional oscillations, which now occur as clearly perceptible resonances, while the transverse oscillation behavior of the musical strings could be improved by the increased manufacturing quality.

It would therefore be desirable and advantageous to provide an improved musical which obviates prior art shortcomings and exhibits outstanding sound.

SUMMARY OF THE INVENTION

According to one aspect of the present invention, a musical string, in particular a string instrument musical string, has a substantially circularly-cylindrical outer contour and includes an inner part, with the inner part including at least one supporting string core and having an inner part cross section which is delimited by an inner part boundary line having a first curved, convex boundary line section at least in a predefined length section of the musical string, said inner part cross section defined by a width and a height in perpendicular relation to the width, with the width being greater than the height.

A musical string according to the present invention has an outstanding sound. The resonances, therefore both the resonant frequencies and also the quality, of the torsional oscillations may thus be influenced directly. Negative effects can thus be prevented from being overemphasized. The strong formation of individual undesired torsional oscillations can thus be prevented. Resonances in the case of torsional oscillations can thus be moved into less tonally relevant or critical ranges.

The dependent claims relate to further advantageous features of the present invention.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
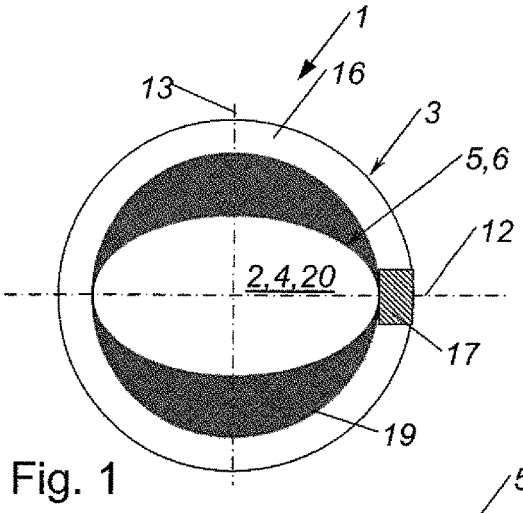
FIG. 1 shows a schematic illustration of a first embodiment of a musical string according to the present invention having a first variant of an inner part.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

FIGS. 1 to 10 show preferred and/or exemplary embodiments of a musical string 1, in particular a string instrument musical string, wherein the musical string 1 has a substantially circularly-cylindrical outer contour 3, wherein an inner part 4 having an inner part cross section 20 delimited by an inner part boundary line 5 is arranged inside the musical string 1, which inner part 4 comprises at least one supporting string core 2 of the musical string 1, wherein, at least in a predefinable length section of the musical string 1, the inner part boundary line 5 has at least one first curved, convex boundary line section 6, and a width 7 of the inner part cross section 20 is greater than a height 8 of the inner part cross section 20 perpendicularly to the width 7.

A musical string 1 can thus be provided which has an outstanding sound. The resonances, therefore both the resonant frequencies and also the quality, of the torsional oscillations can thus be directly influenced. Negative effects can thus be prevented from being overemphasized. The strong formation of individual, undesired torsional oscillations can thus be prevented. Resonances in the case of torsional oscillations can thus be moved into less tonally relevant and/or critical ranges.

The various embodiments illustrated in the FIGS. are shown in a simplified illustration. The proportions do not have to correspond to the provided real proportions. For better comprehension, individual parts can be illustrated in a greatly enlarged view and/or with significantly exaggerated proportions. Furthermore, the individual parts of the illustrated musical strings 1 are each shown directly adjacent to one another in the illustrations, wherein in this regard real musical strings 1 according to the present invention can have partial distances between individual parts and/or at individual points.

One preferred area of use of such musical strings 1 are the instruments of the violin family, therefore the violin, the viola, the violoncello or cello, and the bass or double bass or bass violin. Further preferred instruments for use of musical strings 1 according to the invention are viola da gamba and viola d'amore. Such musical strings 1 according to the invention can be provided for all bowed string instruments.

Musical strings 1 according to the invention are provided for generating sound oscillations, wherein a specific type of musical string 1 is provided for use in a specific type of musical instrument, and furthermore they have a tuning tone and a so-called tuning weight as features, wherein the tuning tone indicates the fundamental tone with which a partial length part of the musical string 1—within the total length of the musical string 1 between the end regions thereof—of the length of the scale of the specific type of musical instrument oscillates when the musical string 1 is loaded with the tuning weight, therefore tensioned, and has been naturally excited to an oscillation.

Musical strings 1 according to the invention have a string core 2, which is provided and designed to absorb the load or the tension to which the musical string 1 is subjected in the state tensioned on a musical instrument. The string core 2 is advantageously formed in this case as a single wire, as a wire cable, as a plastic fiber bundle, or as natural gut. Each of these differently formed types of a string core 2 are known per se in musical strings 1, and each have specific advantages or preferred fields of use. The present invention is implementable with respect to the geometrical and/or structural shaping of the string core 2 in this case using any type of the formation of the string core 2, wherein different production methods are to be provided or selected depending on the type of the material from which the string core 2 is formed, however, in order to form the string core 2 accordingly.

With respect to the formation of the string core 2 comprising plastic fibers, any type of plastic fibers can be provided, for example, comprising polymer fibers, in particular comprising polyamides, aramid fibers, PEK, PAEK, PEEK, PBT, polyester, nylon, polyethylene, PET, PEET, PES, PE, PP, POM, PTFE, PVDF, PVDC, and/or PVC.

The musical string 1 has a substantially circularly-cylindrical outer contour 3 when the musical string 1 is tensioned.

Musical strings 1 for string instruments for lower tunings generally have wrappings or winding layers 16, 18, 21, to increase the mass covering of the musical string 1. The fundamental frequency at which a musical string 1 oscillates is dependent on the oscillating length or the scale of the relevant musical string 1, the force with which the relevant musical string 1 is tensioned, and on the mass covering of the musical string 1. Advantageously the musical string 1 has at least one outer winding layer 16, which has at least one first winding element 17, wherein the at least one first winding element 17 is wound in a helical line around the string core 2. The outer winding layer 16 does not have to be wound directly onto the string core 2 in this case. Advantageously, the musical string 1 has at least one further winding layer 18, 21, 22, which is arranged between the string core 2 and the outer winding layer 16. A circular outer circumference of the musical string 1 or a circularly-cylindrical outer contour at 3 can be realized by applying one of the winding layers to the inner part 4, and then removing regions which are located outside the circularly-cylindrical outer contour 3, e.g. by a machining process.

The at least one first winding element 17 of the outer winding layer 16 can advantageously be formed as a strip, having substantially rectangular cross section and specifiable edge forming. Provision may also be made for multiple strips to be arranged in the form of a multi-thread helical line in the outer winding layer 16.

The winding elements of the at least one further winding layer 18, 21 can also be formed as a strip, or as a round wire, wherein multiple winding elements can also be provided in a further winding layer 18, 21.

The at least one round wire or the at least one strip can be formed from at least one material selected from the group: aluminum, magnesium, iron, chromium, nickel, silicon, silver, gold, platinum, rhodium, copper, and tungsten, wherein each of the mentioned materials can be provided as a pure material in the technical meaning, or also as a component of an alloy. Musical strings 1 have proven to be particularly advantageous in which the at least one round wire or the at least one strip is formed comprising at least one alloy selected from the group: steel, aluminum-magnesium alloys, aluminum-magnesium-manganese alloys, silver-copper alloys, silver-platinum alloys, silver-rhodium alloys, silver-palladium alloys, iron-chromium-nickel-silicone-aluminum alloys.

Provision may be made for a polymeric bonding and/or damping layer 19 between the inner part 4 and the adjoining winding layer 16, 18 and/or between two adjacent winding layers 16, 18, 21.

The bonding and/or damping layer 19 is preferably formed in this case comprising wax, in particular natural wax, such as beeswax or carnauba wax, and/or artificial waxes, such as polyolefin waxes, paraffin, oils, such as fatty oils, mineral oils, and/or synthetic oils, resin, in particular natural resin, such as larch resin and/or spruce resin, and/or artificial resins, such as polyester resin, phenol resin, and/or epoxy resin, wherein further additives can be provided, such as metal powder.

A so-called inner part 4 having an inner part cross section 20 is arranged inside the musical string 2 or the circularly-cylindrical outer contour 3, wherein the inner part cross section 20 is enclosed or bordered by an inner part boundary line 5. The inner part cross section 20 is to be defined essentially perpendicularly to the longitudinal extension of the musical string in this case. The inner part boundary line 5 refers to the entire border of the inner part cross section 20 and not only a part thereof.

The inner part 4 comprises at least one supporting string core 2 of the musical string 1, but can furthermore also comprise one or more winding layers 18, 21.

It is provided that the inner part boundary line 5 has at least one first curved, convex boundary line section 6, and a width 7 of the inner part cross section 20 is greater than a height 8 of the inner part cross section 20 perpendicularly to the width 7. The terms of the width 7 and height 8 are exchangeable in this case. They are only shown in FIGS. 3 and 5 for reasons of comprehensibility.

The inner part 4 is formed correspondingly at least over a specifiable length section of the musical string 1, wherein it is provided in particular that the inner part 4 is formed correspondingly within the length section which is used in operation on a musical instrument for generating the sound oscillations. This is easily specifiable or definable on the basis of the known typical dimensions of musical instruments. It can also be provided in this case that the musical string 1 has a correspondingly formed inner part 4 over its entire length.

Advantageously, the width 7 of the inner part cross section 20 of the inner part 4 is at least 110%, in particular at least 120% of the height 8 of the inner part 4, whereby significant effects can be achieved by the different extensions in the two directions.

The inner part boundary line 5 has at least one first curved, convex boundary line section 6. Advantageously, the inner part boundary line 5 has at least one second curved, convex boundary line section 9. It has been shown that curved partial sections of the inner part boundary line 5 result in or contribute to less pronounced individual resonances than is the case with an inner part cross section 20 which is only formed by straight lines. The resonance behavior of the musical string 1 thus becomes more diffuse with respect to the torsional oscillations.

A curve or curved shape is, in the present context, a curved line, wherein a straight line is not a curve or is not curved. A curve accordingly has at least one radius of curvature, which is non-infinite.

Figure 6:
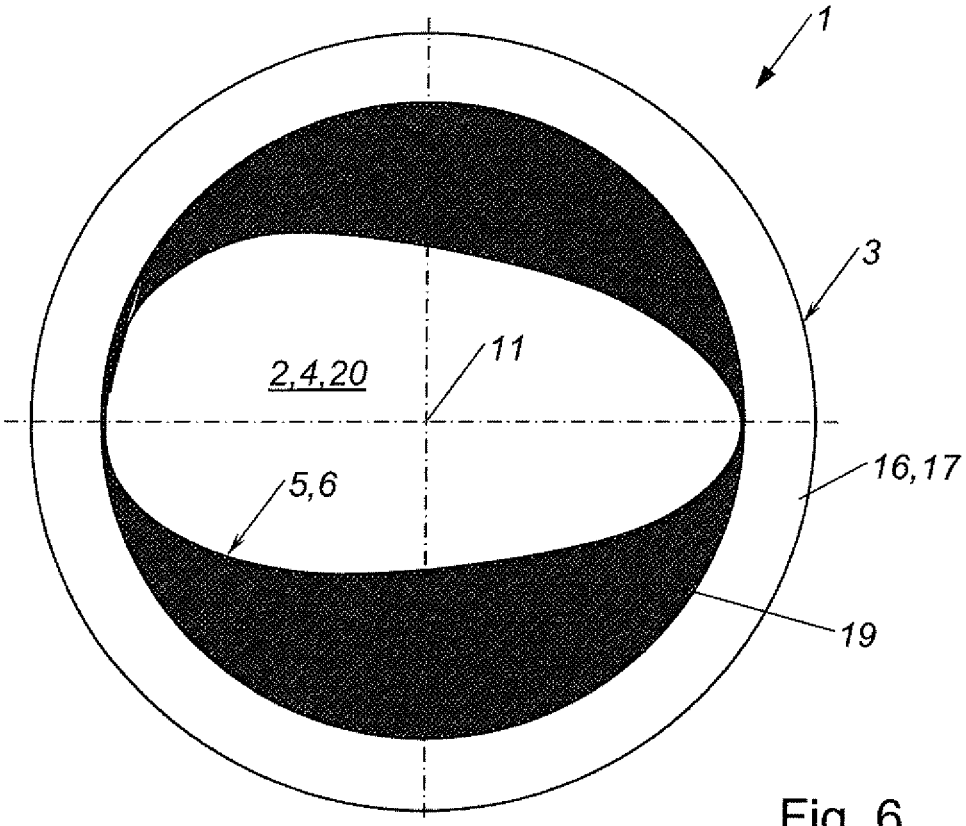
FIG. 6 shows a schematic illustration of a third embodiment of a musical string according to the present invention having a fifth variant of an inner part.

The two curved, convex boundary line sections 6, 9 can be shaped differently, wherein completely irregularly formed curves can also be provided, as shown in FIG. 6, for example.

At least one half of the first boundary line section 6 and/or the second boundary line section 9 can be formed as a conical section line, in particular as a circular arc, hyperbola, parabola, and/or ellipsoid arc. The simple production ability of the musical string 1 is thus assisted. Furthermore, the design of the musical string 1 is thus assisted, because the behavior of an inner part cross section 20 made of such boundary line sections is already better predictable without tests than in the case of entirely irregularly formed inner part cross sections 20. FIGS. 1 to 5 and 7 to 10 show correspondingly formed inner parts 4 or inner part cross sections 20.

Although boundary line sections 6, 9 in the form of a circular arc are easily producible, it has been shown that above all boundary line sections 6, 9 which are not completely formed as a circular arc or in particular boundary line sections 6, 9 which are free of a circular arc are advantageous with respect to the oscillation behavior thereof. According to an array of preferred embodiments, it is therefore provided that a first radius of curvature at a first point of the first boundary line section 6 and/or the second boundary line section 9 is different from a second radius of curvature at a second point, which is different from the first point, of the first boundary line section 6 or the second boundary line section 9.

With respect to the formation of the inner part 4, it can be provided that it is formed irregularly without symmetries, as shown in FIG. 6, for example. It is preferably provided that an inner part cross section 20 of the inner part 4 has a first axis of symmetry 12. It is particularly advantageous, when the inner part cross section 20 has a second axis of symmetry 13, wherein the second axis of symmetry 13 is preferably arranged perpendicularly to the first axis of symmetry 12. Symmetries simplify design and production of an inner part 4 in this case, and can result in more pronounced individual resonances.

Preferred embodiments of musical strings 1 and/or of inner parts 4 of musical strings 1 are described in greater detail hereafter on the basis of FIGS. 1 to 10. If not expressly excluded, combinations of individual features of the individual embodiments are provided. In particular, for each described inner part 4, a specifiable plurality of winding layers 16, 18, 21 can be provided, preferably one, two, three, four, or five winding layers.

FIG. 1 shows a first embodiment of a musical string 1 having a first variant of an inner part 4. The inner part 4 has a substantially elliptical inner part cross section 20. The elliptical inner part cross section 20 has two axes of symmetry 12, 13. The inner part 4 is enclosed by a specifiable bonding and/or damping layer 19, which fills up crescent-shaped regions between the inner part 4 and the outer winding layers 16. In this case, it can be provided that during the production of the relevant musical string 1, the bonding and/or damping layer 19 is applied to the inner part 4, after a specifiable duration, the roundness of the bonding and/or damping layer 19 is produced, for example, by sanding or plastic forming, and subsequently the outer winding layer 16 is applied. In the first variant of an inner part, it only comprises the string core 2.

An elliptical inner part cross section 20, as is also provided in further embodiments, has a good balance between production ability and acoustic effect. Such a cross section is easily producible in particular upon formation of the string core 2 from a single wire, single plastic strand, or a fiber bundle.

Figure 2:
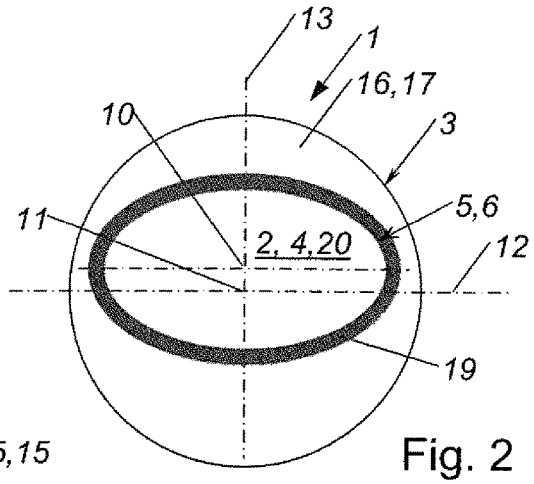
FIG. 2 shows a schematic illustration of a second embodiment of a musical string according to the present invention having the first variant of an inner part.

FIG. 2 shows a second embodiment of a musical string 1, wherein the inner part 4 and/or the string core 2 is formed according to the above-described first variant of an inner part 4 according to FIG. 1. In the musical string 1 according to FIG. 2, it is provided that a mass center of gravity 10 of the inner part 4 is spaced apart from a center point 11 of the circular outer contour 3. The torsional oscillation behavior of the musical string 1 can thus be influenced very strongly.

The relevant musical string 1 according to FIG. 2 furthermore has a relatively thin bonding and/or damping layer 19, which substantially follows the contour of the inner part 4. The outer winding layer 16 is arranged on the bonding and/or damping layer 19. It is provided in this case that it is wound pressing against the elliptical inner part 4, and subsequently the round outer contour of the musical string 1 is achieved by abrading the protruding regions of the applied winding 16.

Figure 3:
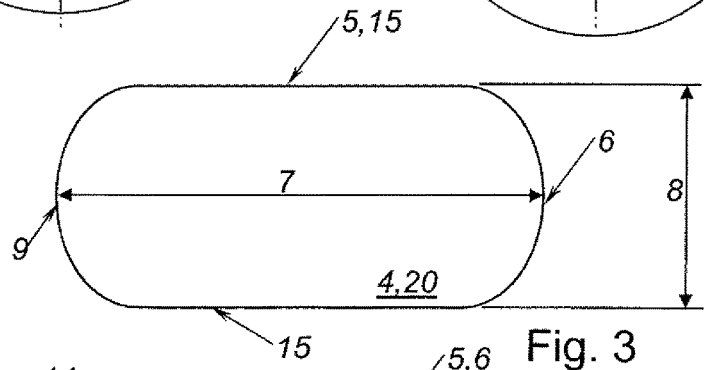
FIG. 3 shows a schematic illustration of a second variant of an inner part.

FIG. 3 shows a second variant of an inner part 4. According to this and other preferred embodiments of an inner part 4, it is provided that the inner part boundary line 5 has at least one linear section 15, in particular two, preferably parallel linear sections 15. Such linear sections 15 represent, together with the at least one convex and curved boundary line section 6, 9, a further effective means for controlling and/or influencing the torsional oscillation behavior of the musical string 1. Moreover, they are easily producible, for example, by rolling or grinding.

The inner part 4 according to FIG. 3 corresponds in this case to a currently preferred embodiment of an inner part 4 having an inner part cross section 20, which is bounded by two parallel linear sections 15 of substantially equal length, which are connected on both sides by the first and second equivalent curved, convex boundary line sections 6, 9. Such an inner part 4 is particularly easily producible, in that a previously round blank is rolled. According to the inner part 4 shown in FIG. 3, it is provided that the two boundary line sections 6, 9 are formed substantially as semi-ellipsoids, wherein deviating embodiments can also be provided, however.

In general, in the formation of the inner part boundary line 5 which comprises at least one linear section 15, it can be provided that the transition to an adjoining boundary line section 6, 9 is formed as an edge 14 or rounded. Advantageously, at least one transition between one of the linear sections 15 and the first and/or second curved, convex boundary line section 6, 9 has a specifiable rounding. FIG. 3 shows a correspondingly formed inner part 4.

Figure 4:
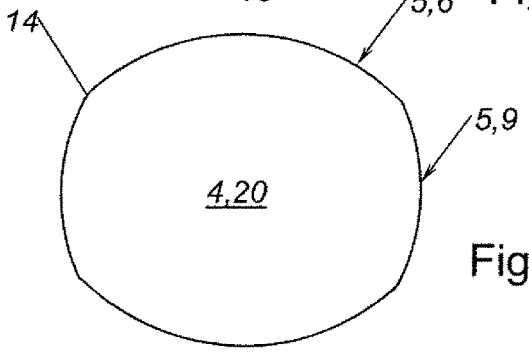
FIG. 4 shows a schematic illustration of a third variant of an inner part.

FIG. 4 shows a third variant of an inner part 4, wherein the inner part 4 has a substantially barrel-shaped inner part cross section 20. Barrel-shaped refers in this case in particular to a cross section corresponding to the concept of the "barrel distortion" as is known from the field of optics and/or photography. Therefore, a cross section which has four curved, convex boundary line sections 6, 9, which merge into one another at corners and/or transition regions, having specifiable edge formation or rounding. In the presence of a barrel-shaped inner part cross section 20, it is provided that at least one transition between one of the linear sections 15 and the first and/or second curved, convex boundary line section 6, 9 is formed as an edge 14. This is preferably also provided in other forms of an inner part cross section 20.

Figure 5:
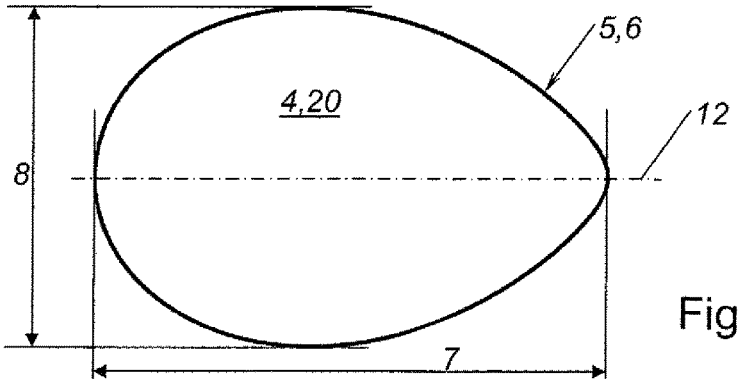
FIG. 5 shows a schematic illustration of a fourth variant of an inner part.

FIG. 5 shows a fourth variant of an inner part 4, wherein it has a substantially oval, in particular egg-shaped inner part cross section 20. The inner part 4 according to FIG. 5 has in this case, in contrast to the variants according to FIGS. 1 to 4, only one axis of symmetry 12. Due to the slight eccentricity of the egg shape, a certain frequency in the resonance behavior can be emphasized or attenuated in a very defined manner.

FIG. 6 shows a third embodiment of a musical string 1 having a fifth variant of an inner part 4, wherein both the inner part cross section 20 and also the inner part boundary line 5 are formed irregularly, and do not have symmetry. The torsional oscillation behavior of the musical string 1 can be adapted very accurately using such freely formed inner part cross sections 20. The inner part 4 according to the third embodiment of a musical string 1 is enveloped with a bonding and/or damping layer 19, around which an outer winding layer 16 is arranged.

Figure 7:
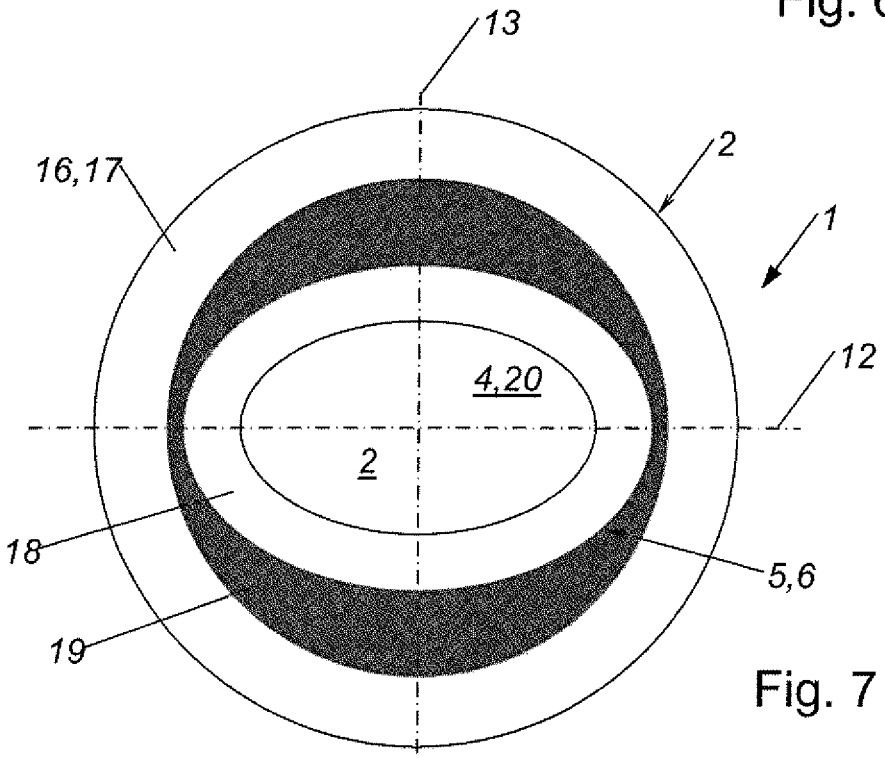
FIG. 7 shows a schematic illustration of a fourth embodiment of a musical string according to the present invention having a sixth variant of an inner part.

FIG. 7 shows a fourth embodiment of a musical string 1 having a sixth variant of an inner part 4. The inner part 4 consists in this case of the string core 2 and a further or inner winding layer 18, which is wound essentially directly onto the elliptical string core 2. With unchanged and desired high load of the string core 2, the mass of the inner part 4 and accordingly its effect can thus be increased. Together with the phenomenon of sliding or friction occurring at the contact regions between string core 2 and the further winding layer 18, a further possibility thus exists influencing the torsional oscillation behavior of the musical string 1.

The musical string 1 according to FIG. 7 furthermore has a bonding and/or damping layer 19, in which the inner part 4 is embedded, and an outer winding layer 16, which is arranged around the bonding and/or damping layer 19.

Figure 8:
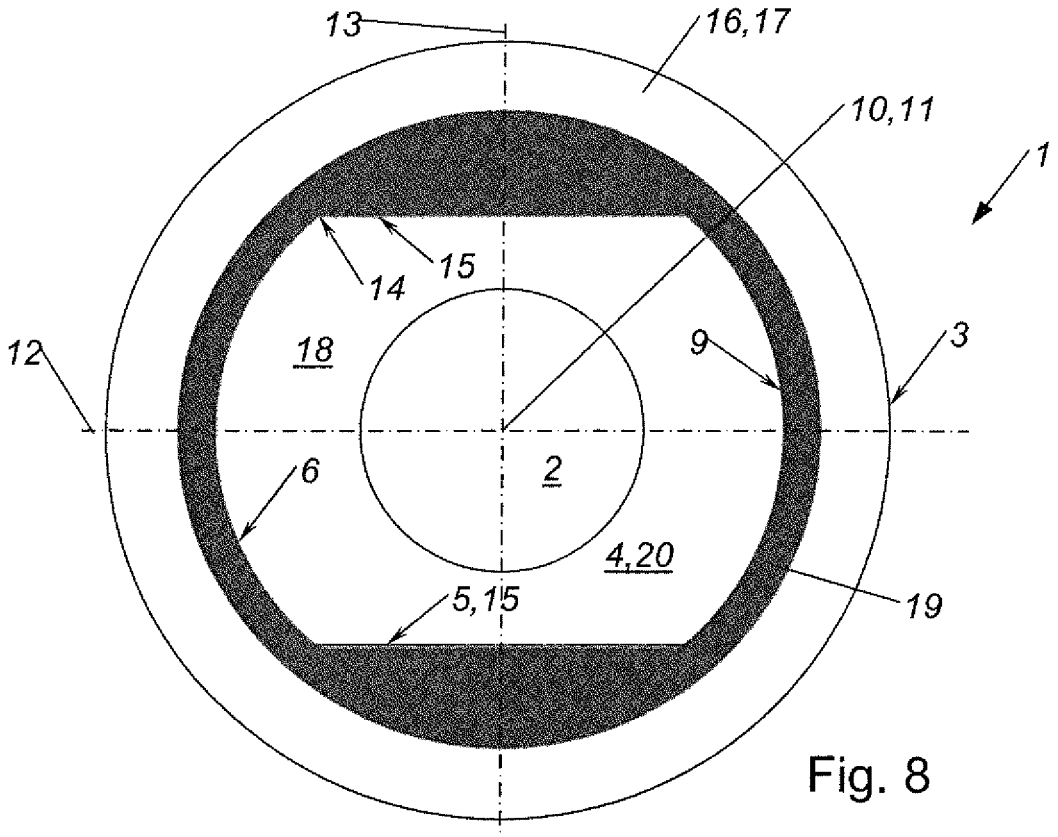
FIG. 8 shows a schematic illustration of a fifth embodiment of a musical string according to the present invention having a seventh variant of an inner part.

FIG. 8 shows a fifth embodiment of a musical string 1 having a seventh variant of an inner part 4, wherein the inner part 4 has a substantially circular string core 2 and an inner or further winding layer 18, which is wound substantially directly onto the circular string core 2. The further winding layer 18 has two substantially parallel linear sections 15 in this case, and also two curved, convex boundary line sections 6, 9, which are formed as circular arcs. Such an inner part 4 can be formed easily by grinding off the further winding layer 18. The musical string 1 according to FIG. 8 furthermore has a bonding and/or damping layer 19, which is arranged between the inner part 4 and the outer winding layer 16.

Figure 9:
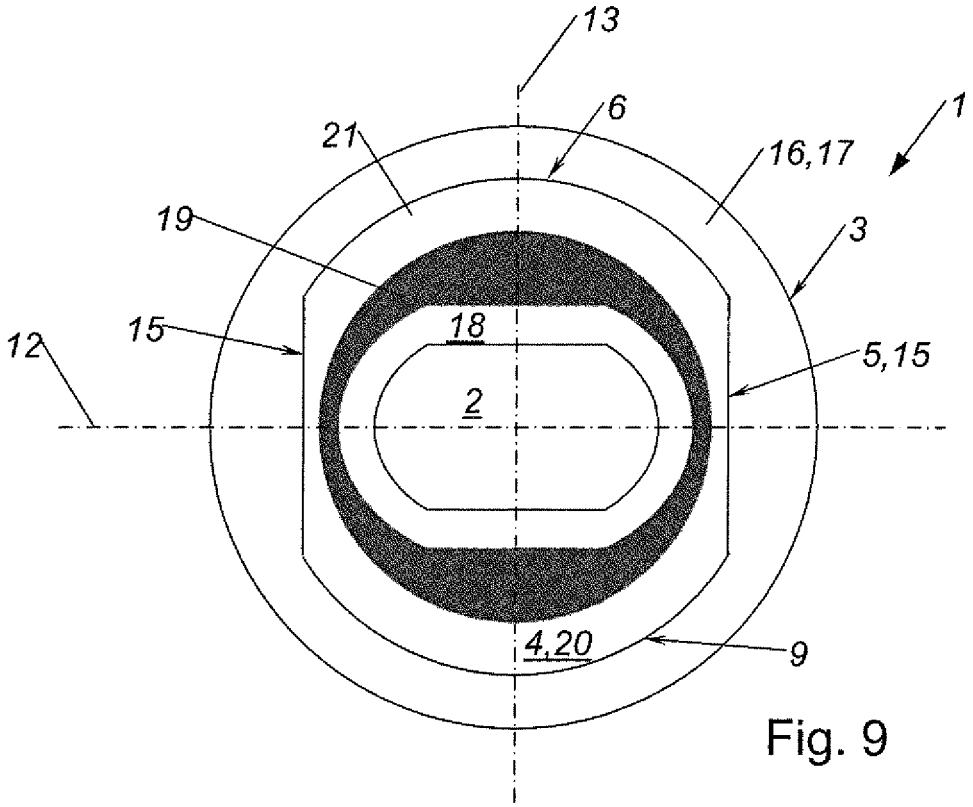
FIG. 9 shows a schematic illustration of a sixth embodiment of a musical string according to the present invention having an eighth variant of an inner part.

FIG. 9 shows a sixth embodiment of a musical string 1 having an eighth variant of an inner part 4, wherein the inner part 4 has a string core 2, an inner or further winding layer 18, and a middle winding layer 21. Both the string core 2 and also the further winding layer 18 have substantially parallel linear sections 15 in this case, and also two curved, convex boundary line sections 6, 9, which are formed as ellipsoid arcs. Such an inner part 4 can be produced easily, in that a circular string core 2 is wrapped with a further winding layer 18 and subsequently-along the longitudinal extension of the musical string 1—first compressed and subsequently ground. The composite made of string core 2 with further winding layer 18 is embedded in a bonding and/or damping layer 19, which is enveloped by the middle winding layer 21. The middle winding layer 21 has two substantially parallel linear sections 15 in this case, and two curved, convex boundary line sections 6, 9, which are formed as circular arcs. The middle winding layer 21 is enveloped by an outer winding layer 16, which is advantageously made of a soft material which can be formed well in a ductile manner, for example, gold or aluminum, and which was ground and/or sanded round after the application. The linear sections 15 of the middle winding layer 21 are arranged perpendicularly to the linear sections 15 of the further winding layer 18.

Advantageously, the inner part 4 is turned in a specifiable manner about a longitudinal axis of the musical string 1.

Several methods for producing the inner part 4 were already described above. In addition to the production of a corresponding inner part cross section 20 by using a starting material already extruded in this manner, the following production methods have proven to be advantageous: grinding, squeezing, etching, plating, and rolling. Furthermore, forming by means of heating, for example, by thermosetting, has proven to be advantageous upon the use of plastic threads.

Figure 10:
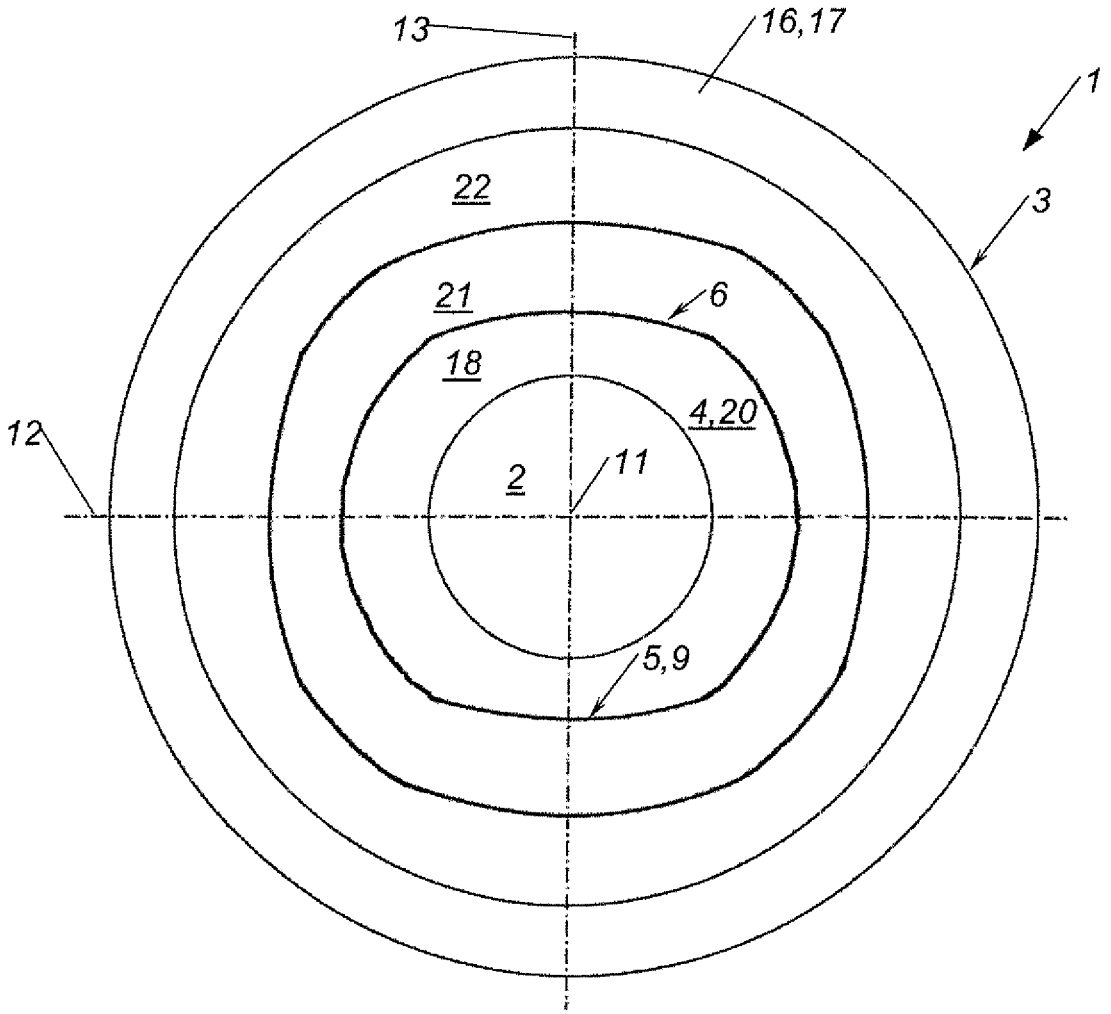
FIG. 10 shows a schematic illustration of a seventh embodiment of a musical string according to the present invention having a ninth variant of an inner part.

FIG. 10 shows a seventh embodiment of a musical string 1 having a ninth variant of an inner part 4, wherein the inner part 4 has a substantially circular string core 2 and an inner or further winding layer 18, which is wound substantially directly onto the circular string core 2. The further winding layer 18 has in this case four curved, convex boundary line sections 6, 9, which are each formed as circular arcs, wherein the circular arcs arranged opposite to one another each have a substantially identical radius. The radii of the adjacent circular arcs differ, however. A first middle winding layer 21 is arranged around the inner part 4 formed in this manner, which is preferably formed from a sufficiently soft material so that the first middle winding layer 21 can follow the contour of the further winding layer 18, wherein it has two regions having larger radius. After the arrangement thereof, the first middle winding layer 21 is processed, wherein the boundary line thereof is subsequently formed from eight circular arcs, wherein preferably each four of the circular arcs have identical radii to one another, wherein the radii of adjacent circular arcs each differ. It can also be provided in this case that circular arcs having more than two different radii, in particular three, four, five, six, seven, or eight, are arranged around the circumferential line. A second middle winding layer 22 is arranged between the first middle winding layer 21 and the outer winding layer 16. Furthermore, a bonding and/or damping layer 19 (not shown) can be arranged between individual or all adjacent winding layers 16, 18, 21, 22 and/or the string core 2 and the adjoining winding layer 18.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A musical string, in particular a string instrument musical string, said musical string having a substantially circularly-cylindrical outer contour and comprising an inner part including at least one supporting string core and having an inner part cross section which is delimited by an inner part boundary line having a first curved, convex boundary line section at least in a predefined length section of the musical string, said inner part cross section defined by a width and a height in perpendicular relation to the width, with the width being greater than the height.

2. The musical string of claim 1, wherein the width is at least 110%, in particular at feast 120%, of the height.

3. The musical string of claim 1, wherein the inner part boundary line has a second curved, convex boundary line section.

4. The musical string of claim 1, wherein the inner part has a mass center of gravity in spaced-apart relation to a center point of the outer contour.

5. The musical string of claim 1, wherein the inner part cross section of the inner part has a first axis of symmetry.

6. The musical string of claim 5, wherein the inner part cross section has a second axis of symmetry.

7. The musical string of claim 6, wherein the second axis of symmetry extends in perpendicular relation to the first axis of symmetry.

8. The musical string of claim 3, wherein at least one half of the first boundary line section and/or the second boundary line section is formed as a conical section line, in particular as a circular arc, hyperbola, parabola, and/or ellipsoid arc.

9. The musical string of claim 3, wherein at least one member selected from the group consisting of the first boundary line section and the second boundary line section is defined by a first radius of curvature at a first point of the member and by a second radius of curvature at a second point of the member, which second point is different from the first point, said first radius being different from the second radius.

10. The musical string of claim 1, wherein the inner part cross section of the inner part has a substantially elliptical inner part configuration.

11. The musical string of claim 1, wherein the inner part cross section of the inner part has a substantially barrel-shaped configuration.

12. The musical string of claim 1, wherein the inner part cross section of the inner part has a substantially oval, in particular egg-shaped configuration.

13. The musical string of claim 1, wherein the inner part boundary line has at least one linear section, in particular two linear sections, preferably in parallel relation.

14. The musical string of claim 3, wherein the inner part cross section of the inner part is bordered by two parallel linear sections of essentially equal length, said two parallel linear sections being connected on both sides by the first and second curved, convex boundary line sections.

15. The musical string of claim 14, wherein at least one transition between one of the linear sections and at least one of the first and second curved, convex boundary line sections is formed as an edge.

16. The musical string of claim 14, wherein at least one transition between one of the linear sections and at least one of the first and second curved, convex boundary line sections has a specifiable rounding.

17. The musical string of claim 1, further comprising an outer winding layer having at a first winding element which is wound in a helical line around the string core.

18. The musical string of claim 17, further comprising a further winding layer arranged between the string core and the outer winding layer.

19. The musical string of claim 18, wherein the inner part comprises the string core and at least one of the outer and further winding layers.

20. The musical string of claim 1, wherein the string core is designed as a single wire, as a wire cable, as a plastic fiber bundle, or as natural gut.

21. The musical string of claim 18, further comprising a preferably polymeric bonding and/or damping layer arranged between the inner part and an adjoining one of the outer and further winding layers.

* * * * *